US007021961B1

(12) United States Patent
Soderholm

(10) Patent No.: US 7,021,961 B1
(45) Date of Patent: Apr. 4, 2006

(54) WIRING SYSTEM AND POWER DISTRIBUTION CABLE FOR BALANCING ELECTRICAL LOADS

(75) Inventor: Brian James Soderholm, Snellville, GA (US)

(73) Assignee: Acuity Brands, Inc., Atlanta, GA (US)

( * ) Notice: Subject to any disclaimer, the term of this patent is extended or adjusted under 35 U.S.C. 154(b) by 119 days.

(21) Appl. No.: 10/836,600

(22) Filed: Apr. 30, 2004

(51) Int. Cl.
*H01R 11/00* (2006.01)

(52) U.S. Cl. ..... 439/505; 439/215

(58) Field of Classification Search ..... 439/505, 439/502, 215
See application file for complete search history.

(56) References Cited

U.S. PATENT DOCUMENTS 4,146,287 A * 3/1979 Jonsson ..... 439/368
4,367,417 A * 1/1983 Casasanta ..... 307/147
4,399,371 A 8/1983 Ziff et al.
4,464,832 A 8/1984 Asick et al.
5,032,086 A * 7/1991 Skowronski et al. ..... 439/210
5,203,713 A 4/1993 French et al.
5,674,090 A 10/1997 Sumida et al.
5,679,016 A 10/1997 Marder et al.
5,679,023 A 10/1997 Anderson, Jr. et al.
5,819,405 A 10/1998 Marder et al.
6,042,399 A 3/2000 Jaakkola
6,083,053 A 7/2000 Anderson, Jr. et al.
6,102,733 A 8/2000 Anderson, Jr. et al.
6,113,435 A 9/2000 Anderson, Jr. et al.
6,126,490 A 10/2000 Anderson, Jr. et al.
6,303,743 B1 10/2001 Chu et al.
6,422,884 B1 7/2002 Babasick et al.
6,540,549 B1 * 4/2003 Rupert ..... 439/502
6,663,435 B1 12/2003 Lincoln, III et al.
6,663,438 B1 12/2003 Guilmette

* cited by examiner

*Primary Examiner*—P. Austin Bradley
*Assistant Examiner*—X. Chung-Trans
(74) *Attorney, Agent, or Firm*—Needle & Rosenberg, PC

(57) ABSTRACT

A wiring system for distributing three-phase power from a three-phase power supply is provided. The wiring system includes a power distribution cable assembly and a load cable assembly. The power distribution assembly comprises a first power connector head and a second power connector head operatively connected to the respective ends of a length of power cable such that the connection of the power conductors of the respective power terminals disposed in fixed arrays in the respective connector heads is switched. The load cable assembly has a load connector head connected to an end of a load cable. The load connector head has a fixed array of terminals that includes three terminals selected from a group consisting of a first power terminal, a second power terminal, a third power terminal, a neutral terminal, and a ground terminal. The fixed array of terminals of the load connector head is constructed and arranged for releasable connection to one of the fixed arrays of terminals of the second power connector head.

21 Claims, 14 Drawing Sheets

WIRING SYSTEM AND POWER DISTRIBUTION CABLE FOR BALANCING ELECTRICAL LOADS

BACKGROUND OF THE INVENTION

1. Field of the Invention

The invention relates generally to wiring components of relocatable wiring systems and particularly to devices and cables connecting the wiring components of the system for distributing three-phase power to loads.

2. Description of the Prior Art

Electrical wiring for operating lighting fixtures and other circuit loads has long been an art practiced in a variety of similar, basically simple ways. The various forms of "hard-wiring" constitute the bulk of present day wiring methods. "Hardwiring" methods typically involve installation of conduits with wire or cable then being pulled through the conduit. In the case of lighting fixtures, these fixtures must then be hung and connected to the electrical system within the conduit so that the fixtures can then be energized. These prior practices require substantial labor costs which typically account for seventy to eighty percent of total electrical installation job cost.

Prior wiring systems installed by this conventional "pipe and wire process" has the additional disadvantage that it cannot be used for temporary lighting during facility construction and again for permanent lighting since those materials used in hardwiring processes are usually not reusable. Further, circuitry changes due to layout revision or expansion cannot readily be accommodated in prior art hardwiring systems due to a typical inability when using such prior art systems to reuse those materials which have been cut, such as conduit, for a dedicated circuit arrangement. Relocation of lighting fixtures or other electrical loads in the prior art hardwired systems is thus virtually impossible, it usually being necessary to begin the wiring process anew when fixture relocation is necessary. Prior art hardwiring systems also require that a number of different structural elements be kept in inventory, these structural elements including conduit, wire, couplings, connectors, wirenuts and other miscellaneous materials.

Those disadvantages inherent in conventional hard-wiring processes are generally obviated through the employment of wiring systems known particularly in the industrial and commercial lighting fields by the mark RELOC™ which is a trade-mark of Lithonia Lighting, Inc., a Division of Acuity Brands, Inc. of Atlanta, Ga. The manufactured wiring systems marketed under the mark RELOC™ facilitate the construction of industrial and commercial installations through the provision of plug-in, relocatable, modular components suitable for commercial wiring, industrial wiring, access floor wiring, local switching, and power applications. The primary benefits of the RELOC™ manufactured wiring systems include reductions in installation time and labor costs as well as easy fixture relocation. Use of these pre-manufactured relocatable wiring systems can provide labor savings of approximately 75% and total job cost reductions of approximately 25%. The RELOC™ systems also require a minimum number of inventory components which components can be manufactured with high quality control in a manufacturing facility to meet or exceed the requirements of UL, the National Electrical Code, and CSA.

The process of installation of the RELOC™ system requires only a single pass along each branch circuit or row of fixtures in order to install the system and to hang fixtures. The time required for a RELOC™ installation is therefore a fraction of the time necessary for conventional hardwiring systems. Industrial HID fixtures can be installed in a typical warehouse lighting application with substantial labor savings, job labor content using hardwiring processes typically being the highest percentage of a total job cost. Additionally, the RELOC™ system can be used for temporary lighting during facility construction and again for permanent lighting. Fixtures can be easily relocated and circuitry changed due to layout revision, expansion or for other reasons through the use of the RELOC™ wiring system. The RELOC™ wiring system can include a circuit selector associated with lighting fixtures which allows the fixtures to be connected to a particular circuit of a plurality of circuits which are contained within cable which is plugged together through the use of female connector heads and male connector heads located at opposite ends of discrete lengths of cable. These discrete lengths of cable are plugged together to form a desired branch circuit length. Exemplary circuit selection devices are described in detail in U.S. Pat. No. 5,679,016 to Marder et al. and U.S. Pat. No. 5,679,023 to Anderson et al., the disclosures thereof being incorporated by reference herein in their entirety. Other exemplary components of the RELOC™ wiring system are described in detail in U.S. Pat. No. 5,819,405 to Marder et al., U.S. Pat. No. 6,083,053 to Anderson, Jr. et al., U.S. Pat. No. 6,102,733 to Anderson, Jr. et al., U.S. Pat. No. 6,113,435 to Anderson, Jr. et al., U.S. Pat. No. 6,126,490 to Anderson, Jr. et al., the disclosures thereof being incorporated by reference herein in their entirety.

The present invention improves upon the prior art by the provision of a relocatable manufactured wiring system that provides for load balancing and that is relatively inexpensive and more easily manufactured when compared to the structures of the prior art.

SUMMARY OF THE INVENTION

In one aspect of the present invention, a wiring system for distributing three-phase power from a three-phase power supply is provided. The wiring system can include a power distribution cable assembly and a load cable assembly. The power distribution assembly comprises a length of power cable, a first power connector head and a second power connector head. The power cable has a first power conductor, a second power conductor, a third power conductor, a neutral conductor, and a ground conductor.

The first power connector head has a first fixed array of terminals that includes a first power terminal, a second power terminal, a third power terminal, a neutral terminal, and a ground terminal. In use, the first fixed array of terminals is operatively connected to a three-phase power supply such that each respective phase of three-phase power supply is supplied to a separate power terminal of the first array of terminals.

The first array of terminals is operatively connected to a proximal end of the power cable such that each respective terminal of the first array is fixed relative to each other in a predetermined orientation and such that the first power terminal of the first array is connected to the first power conductor, the second power terminal of the first array is connected to the second power conductor, the third power terminal of the first array is connected to the third power conductor, the neutral terminal of the first array is connected to the neutral conductor, and the ground terminal of the first array is connected to the ground conductor.

The second power connector head is operatively connected to a distal end of the power cable and has a second fixed array of terminals that includes a first power terminal, a second power terminal, a third power terminal, a neutral terminal, and a ground terminal. Each respective terminal of the second fixed array of terminals are fixed relative to each other in the same predetermined orientation as the first fixed array of terminals. As one will appreciate, the particular arrangement, i.e., order, of the respective terminals of the fixed arrays discussed in the exemplified embodiments of the components of the present invention remain constant for all array embodiments discussed with regard to the wiring system.

Each respective terminal of the second fixed array of terminals is operatively connected to the power cable such that the neutral conductor is connected to the neutral terminal of the second array, the ground conductor is connected to the ground terminal of the second array, the first power conductor is connected to one power terminal of the second fixed array that is selected from a group consisting of the second power terminal and the third power terminal, the second power conductor is connected to one power terminal of the second array that is selected from a group consisting of the first power terminal and the third power terminal, and the third power conductor is connected to one power terminal of the second array that is selected from a group consisting of the first power terminal and the second power terminal. Each power terminal of the second array of terminals is connected to one power conductor.

The second power connector head can include a third fixed array of terminals that that are fixed relative to each other in the same predetermined orientation as the second fixed array of terminals. The first power terminal of the third array is operatively connected to the first power terminal of the second array. The second power terminal of the third array is operatively connected to the second power terminal of the second array. The third power terminal of the third array is operatively connected to the third power terminal of the second array. The neutral terminal of the third array is operatively connected to the neutral terminal of the second array and the ground terminal of the third array of terminals is operatively connected to the ground terminal of the second array.

In one embodiment, the load cable assembly comprises a length of load cable and a load connector head operatively connected to a first end of the load cable. The load connector head has a fourth fixed array of terminals that includes three terminals selected from a group consisting of a first power terminal, a second power terminal, a third power terminal, a neutral terminal, and a ground terminal. In this example, the three terminals of the fourth fixed array of terminals are fixed relative to each other in the predetermined orientation. The fourth fixed array of terminals of the load connector head is constructed and arranged for releasable connection to one of the fixed arrays of terminals of the second power connector head.

BRIEF DESCRIPTION OF THE DRAWINGS

These and other features and aspects of the present invention will become better understood with reference to the following description, appended claims, and accompanying drawings, where:

FIG. 18 is a schematic depiction of the wiring connections within respective first and second arrays disposed in the respective first and second connector heads of an alternative embodiment of the power distribution cable assembly.

FIG. 20 is an exemplified schematic depiction of the wiring system of the present invention showing an exemplified load distribution using the power distribution cable assembly of FIG. 18.

DETAILED DESCRIPTION OF THE INVENTION

Figure 1:
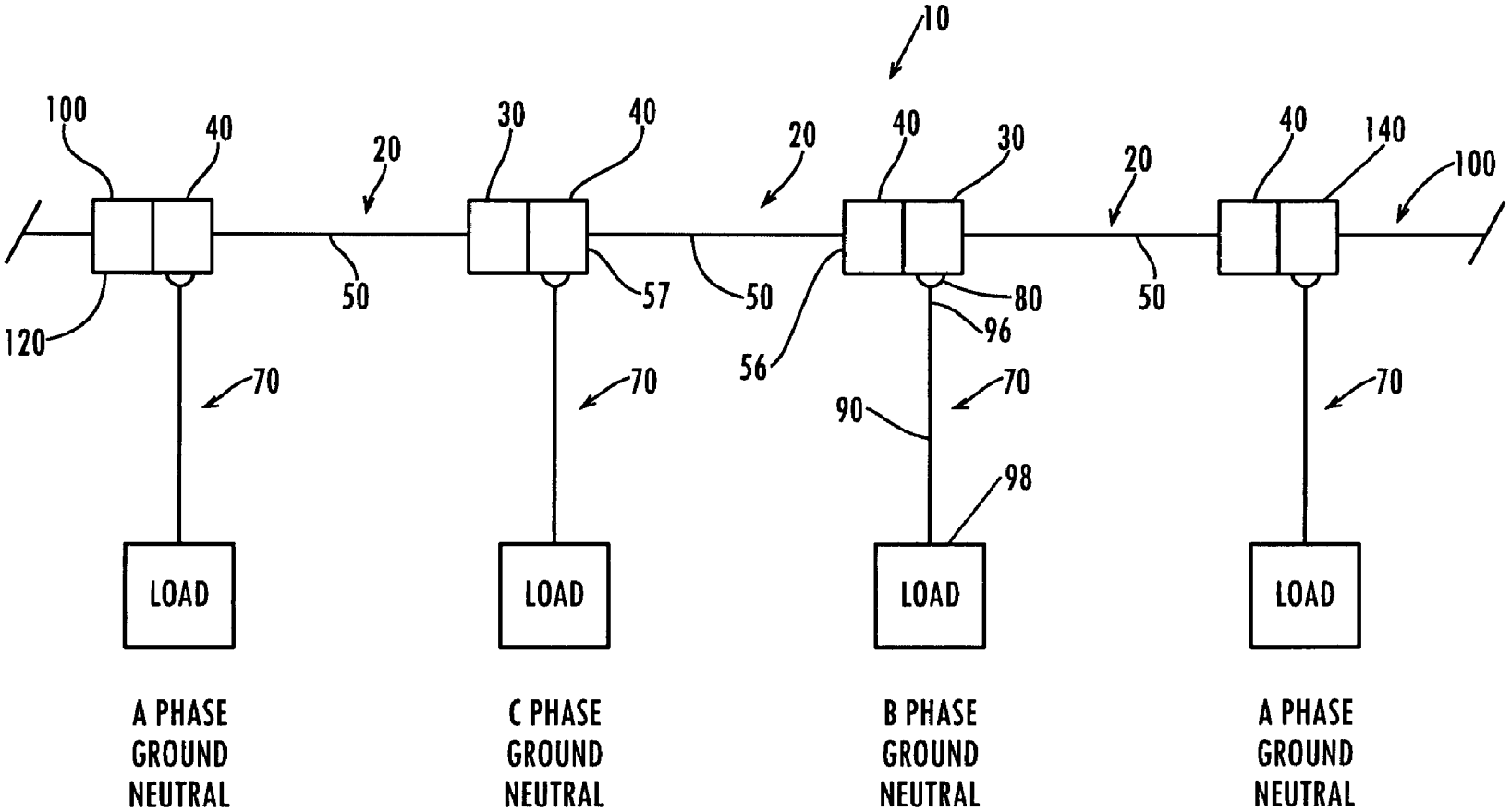
FIG. 1 is an exemplified schematic depiction of the wiring system of the present invention showing an exemplified load distribution using the components of the system of the present invention.
Figure 2:
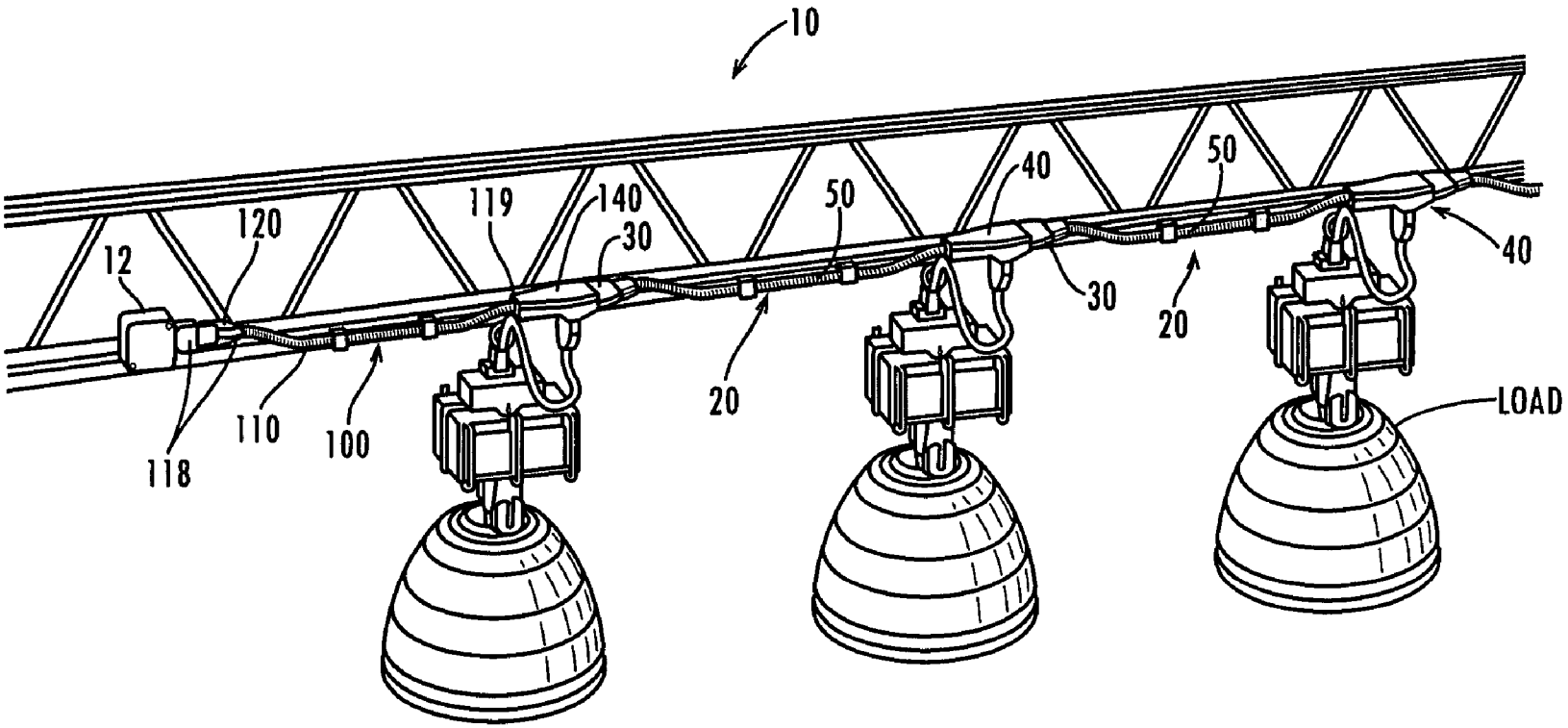
FIG. 2 is an exemplified perspective view of an embodiment of the wiring system of the present invention for distributing three-phase power to connected loads.
Figure 3:
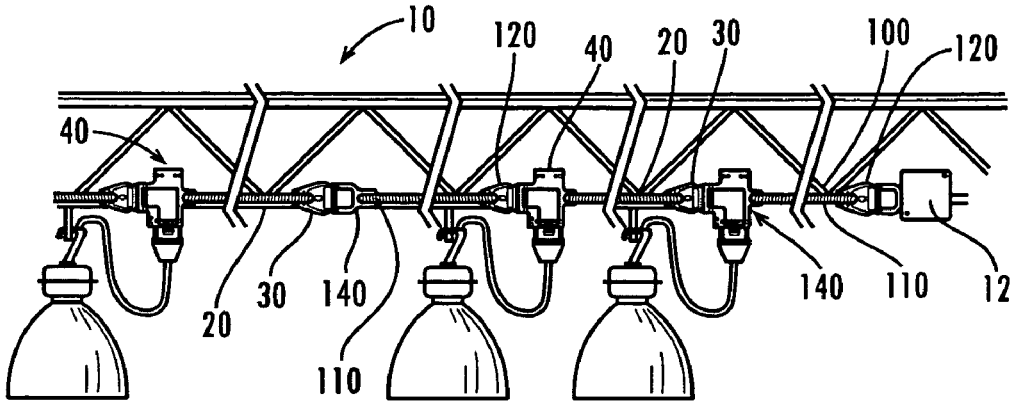
FIG. 3 is an exemplified plan view of an embodiment of the wiring system of the present invention for distributing three-phase power to connected loads.
Figure 4:
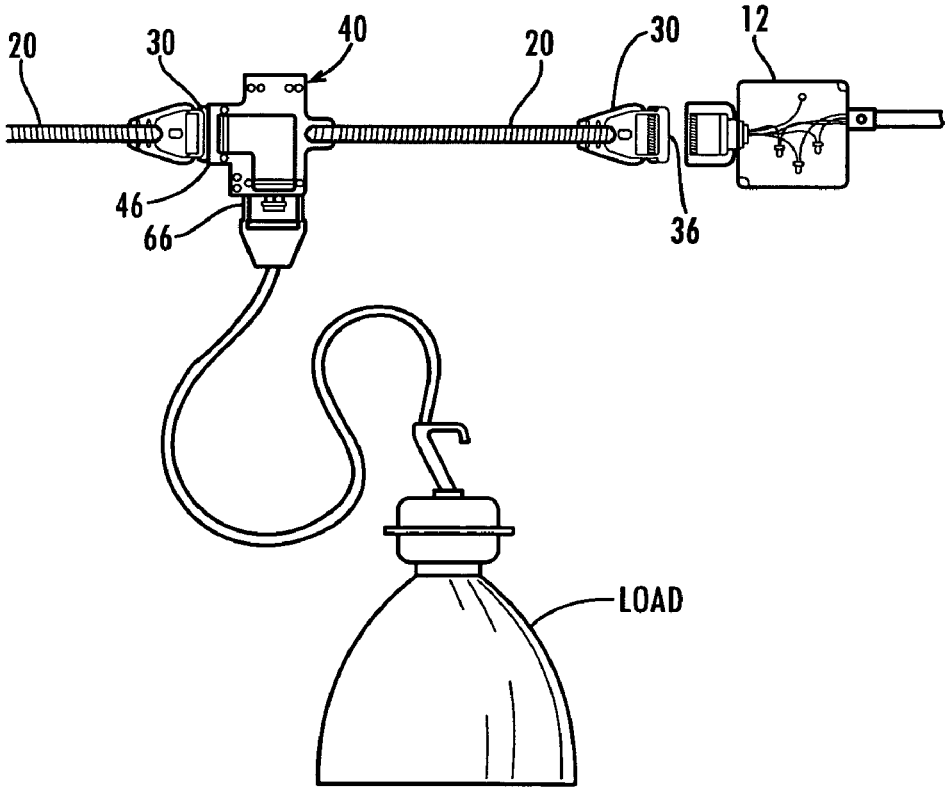
FIG. 4 is an exemplified plan view of an embodiment of the wiring system of the present invention for distributing three-phase power to connected loads.
Figure 5:
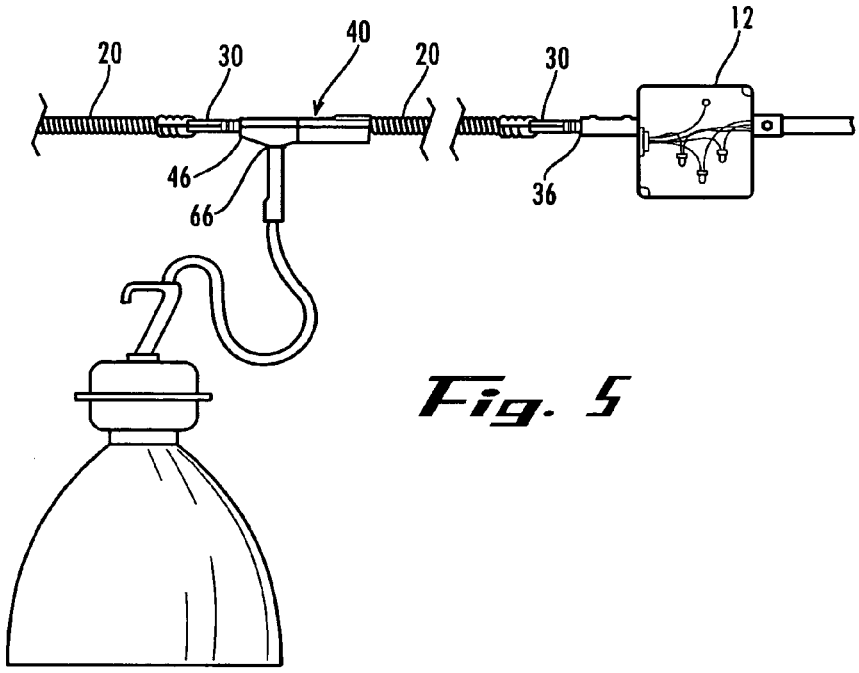
FIG. 5 is an exemplified plan view of an embodiment of the wiring system of the present invention for distributing three-phase power to connected loads.
Figure 7A:
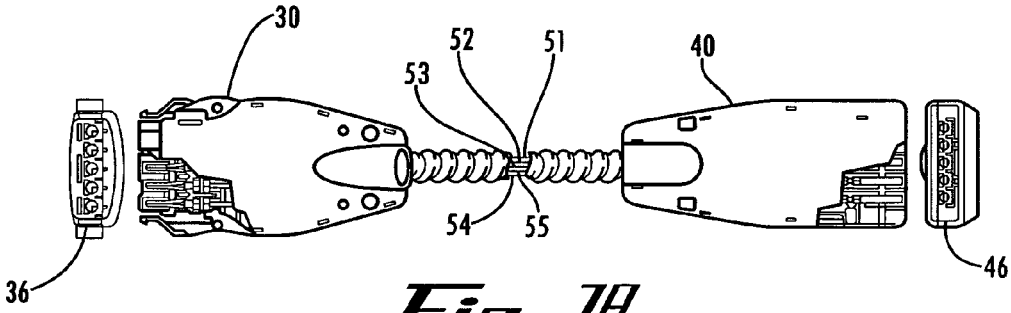
FIGS. 7A and 7B are plan views of the power distribution cable assembly of FIG. 6.
Figure 7B:
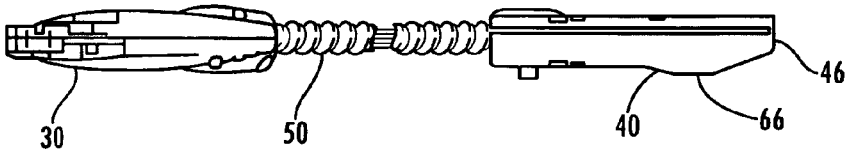
Figure 6:
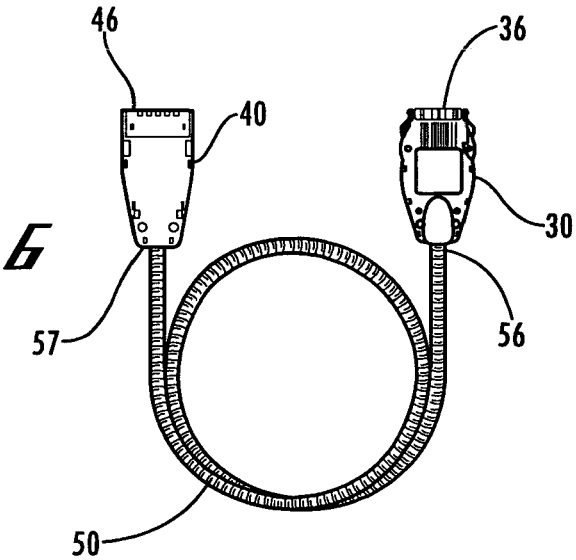
FIG. 6 is a plan view of an exemplified power distribution cable assembly of the present invention.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Referring to the figures, and particularly to FIGS. 1–5, a wiring system 10 for distributing three-phase power from a three-phase power supply 12 is shown. The wiring system allows for flexibility in connecting loads to the power supply with distributing the power to minimize an undue load on any particular phase of the power supply. The modularity of the wiring system of the present invention allows for multiple variations with respect to wiring design configurations.

The power distribution cable assembly 20 of the present invention, which is described in detail below, is wired to permute circuits between input and output ends of the power distribution power assembly in a specific fashion. The specific permutation is chosen so that the fixed pins on the array of terminals of the load connector head of a load cable assembly 70, which are described in detail below, will result in a sequence of load connections that can use each circuit or phase in turn and repeat the sequence as the power distribution cable assemblies are connected in series, resulting in a substantially balanced load between the phases of the three phase power supply. This relieves the installer from the duty of selecting which phase of the power supply they are going to attach a specific load and/or requiring an installer to make a specific required pin or terminal selection for each connection of the wiring system. In use, the present invention allows the installer to connect the various keyed components of the system and the power will be distributed in the desired manner. Additionally, all of the load cable assemblies can be the same and all of the power distribution cable assemblies can be the same.

The wiring system 10 of the present invention includes at least one power distribution cable assembly 20. Referring to FIGS. 6–11, exemplary embodiments of the power cable assemblies are shown. The power distribution cable assembly 20 of the present invention comprises a first power connector head 30, a second, distal, power connector head 40, and a length of power cable 50 having a first power conductor 51, a second power conductor 52, a third power conductor 53, a ground conductor 54, and a neutral conductor 55. The power cables are exemplarily depicted as conventional metal clad power cables. The power cable can be a conventional polymer clad power cable, but can, as one skilled in the art will appreciate, be another conventional type of power cable. The metal clad power cable is preferably used in the present wiring system because it can be readily cut to length and is less expensive than other options, such as flexible metal conduit. It is noted, however, that the flexible metal conduit could be used in place of metal clad cable.

The power cable 50 of the power distribution assembly is operatively connected at a proximal end 56 to the first power connector head 30, having a first array of terminals 36 that includes three power terminals, a neutral terminal 35, and a ground terminal 34. Each respective terminal of this first array of terminals 36 is fixed relative to the other terminals in a predetermined orientation such that the first power terminal 31 of the first array is connected to the first power conductor 51, the second power terminal 32 of the first array is connected to the second power conductor 52, the third power terminal 33 of the first array is connected to the third power conductor 53, the neutral terminal 35 of the first array is connected to the neutral conductor 55, and the ground terminal 34 of the first array is connected to the ground conductor 54. An exemplary first power connector head 20 is disclosed in U.S. Pat. No. 6,126,490.

The exemplified first array of terminals 36 in the first power connector head 30 is constructed and arranged as a conventional male terminal housing for a quick, releasable connection to a complementary female terminal housing of the three phase power supply. The respective male and female terminal housings are conventionally keyed such that each respective phase of the three phase power supply 12 is supplied to a particular and separate power terminal of the first array of terminals 36. Although the first array of terminals of the first power connector head is exemplified as a male terminal housing, it is contemplated that it may be formed as a female terminal housing, where the three phase power supply was within a male terminal housing.

The distal end 57 of the power cable 50 is operatively connected to the second power connector head 40. The second connector power head has a second array of terminals 46 that includes three power terminals, a neutral terminal 45, and a ground terminal 44. Each respective terminal of the second array of terminals is fixed relative to the other terminals in the same predetermined orientation of the first fixed array of terminals. In this embodiment, the neutral conductor 55 of the power cable is connected to the neutral terminal 45 of the second array of terminals, the ground power conductor 54 of the power cable is connected to the ground terminal 44 of the second array of terminals, the first power conductor 51 of the power cable is connected to either a second power terminal 42 or a third power terminal 43 of the second array of terminals, the second power conductor 52 of the power cable is connected to either a first power terminal 41 or the third power terminal 43 of the second array of terminals, and the third power conductor 53 of the power cable is connected to either the first or second power terminal 41, 42 of the second array of terminals. Each power terminal 41, 42, 43 of the second array of terminals is connected to one separate power conductor 51, 52, 53.

As one will appreciate, the particular arrangement, i.e., order, of the respective terminals of the each of the fixed arrays discussed in the exemplified embodiments of the components of the present invention remain constant for all array embodiments discussed in regard to the wiring system 10. That is, for example, if the respective terminals of the first array of terminals 36 are ordered ground, first power terminal, second power terminal, third power terminal, and neutral terminal (i.e., G, 1, 2, 3, N) then the respective terminals of the second array of terminals 46, and any other array of the exemplified components of the wiring system, would also be ordered ground, first power terminal, second power terminal, third power terminal, and neutral terminal (i.e., G, 1, 2, 3, N). Respective mating terminal arrays of the system are conventionally keyed so that the terminals of two connecting terminal arrays can only be connected in proper orientation—that is, neutral terminal to neutral terminal, first power terminal to first power terminal, second power terminal to second power terminal, third power terminal to third power terminal, and ground terminal to ground terminal, as required and desired.

Figure 8A:
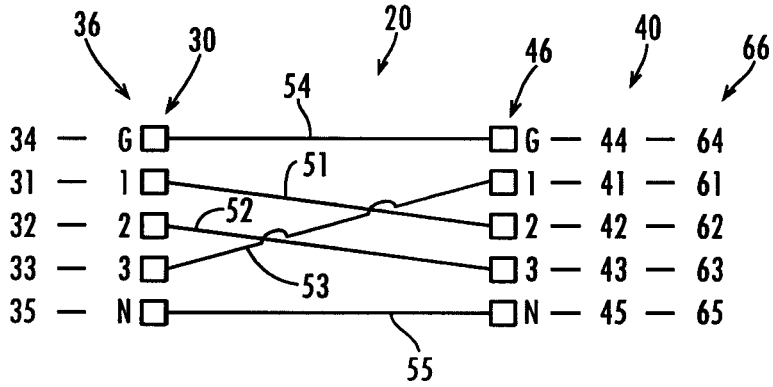
FIGS. 8A and 8B are schematic depictions of the wiring connections within respective first and second arrays disposed in the respective first and second connector heads of the power distribution cable assembly.
Figure 8B:
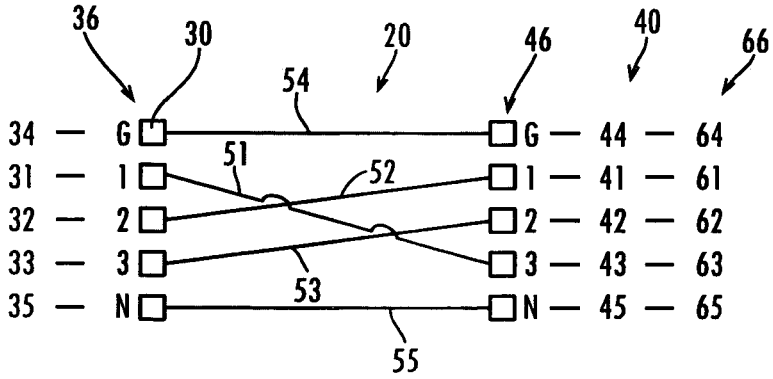
Figure 9:
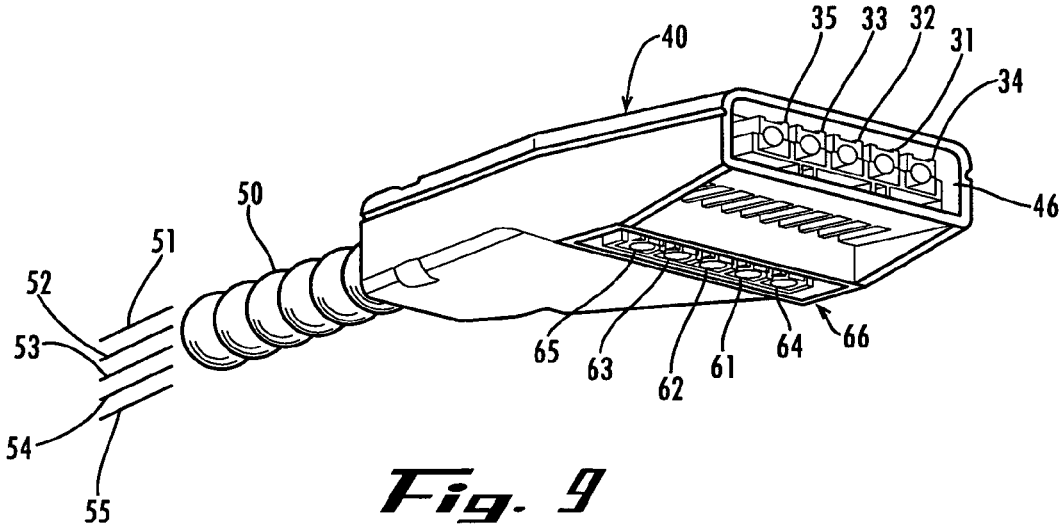
FIG. 9 is a perspective view of an exemplified second power connector head of the power distribution cable assembly showing a third fixed array of terminals that are operatively connected to the second fixed array of terminals.
Figure 10:
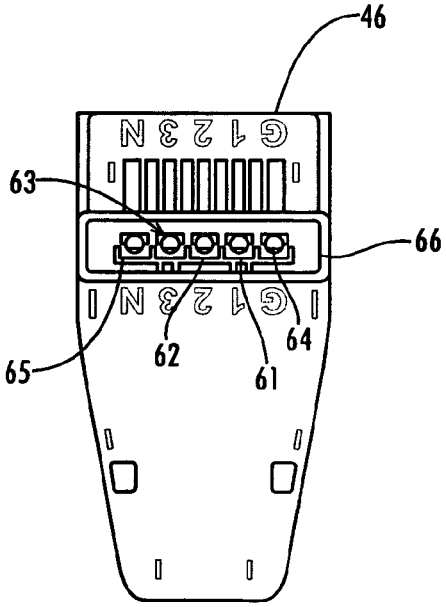
FIG. 10 is a top plan view of the second power connector head of FIG. 9.
Figure 11:
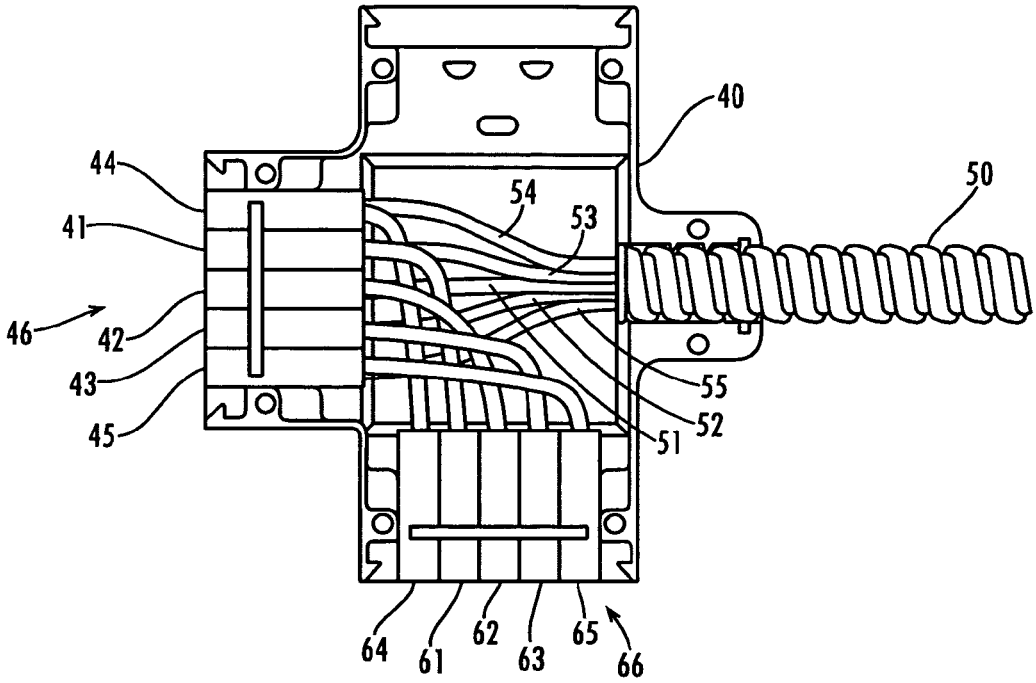
FIG. 11 is a partial, cut-away top plan view of an alternative exemplified second power connector head of the power distribution cable assembly showing a third fixed array of terminals operatively connected to the second fixed array of terminals.
Figure 12:
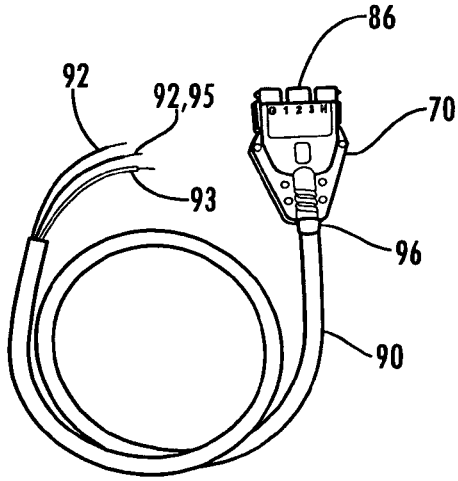
FIG. 12 is a perspective view of an exemplified load cable assembly of the present invention.
Figure 13:
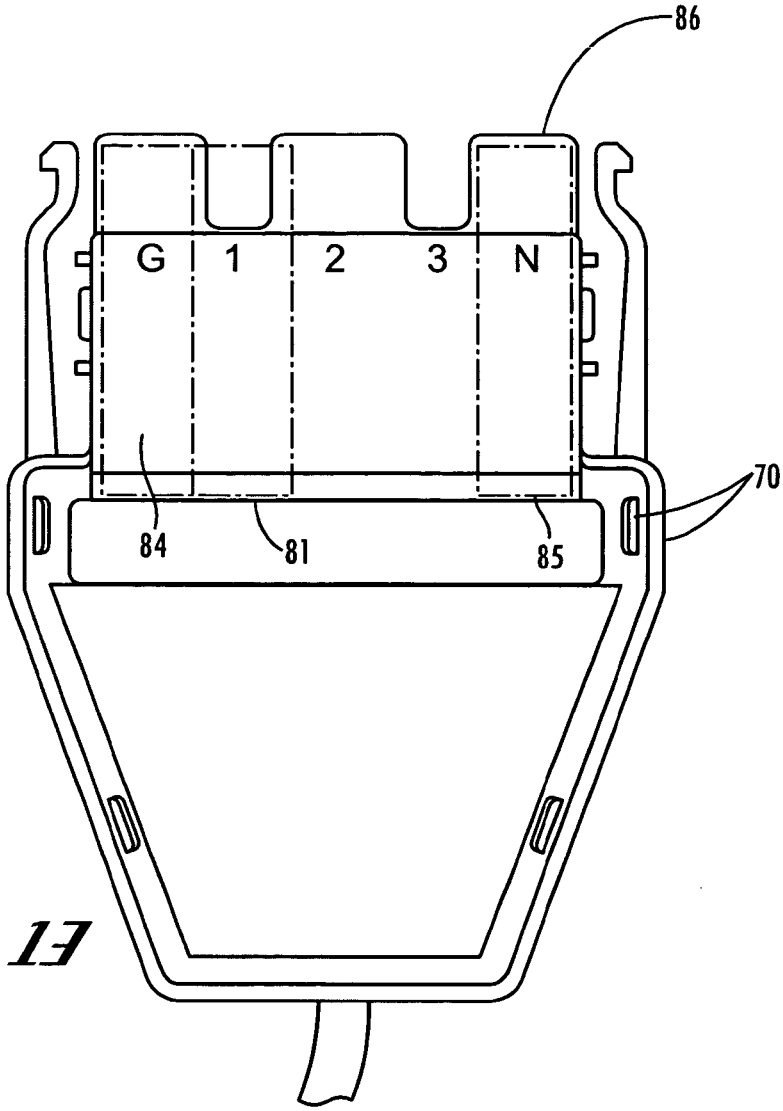
FIG. 13 is a top plan view of an exemplified load connector head of the load cable assembly of FIG. 12.
Figure 14:
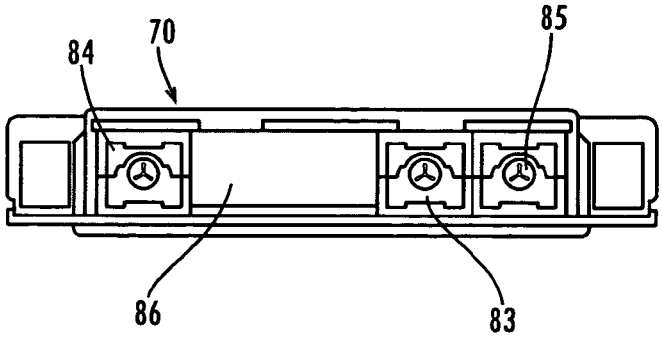
FIG. 14 is an end view of the load connector head of FIG. 13.
Figure 15A:
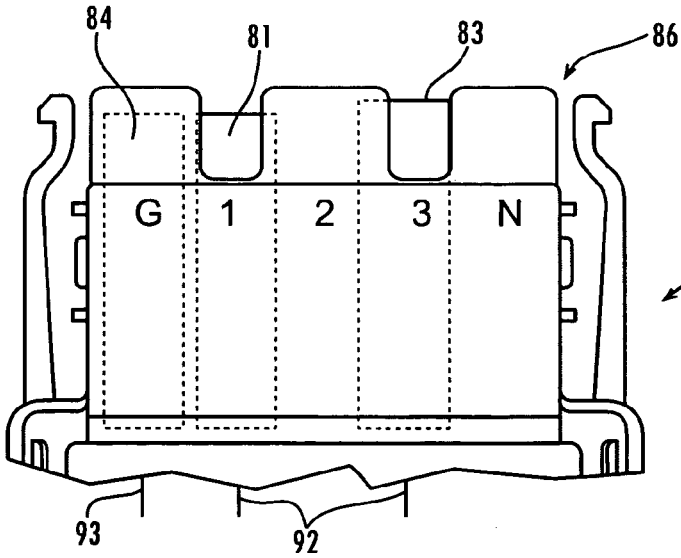
FIGS. 15A, 15B, 15C, 15D, 15E and 15 F are exemplified views of the terminal configurations in the load connector head of FIG. 13.
Figure 15B:
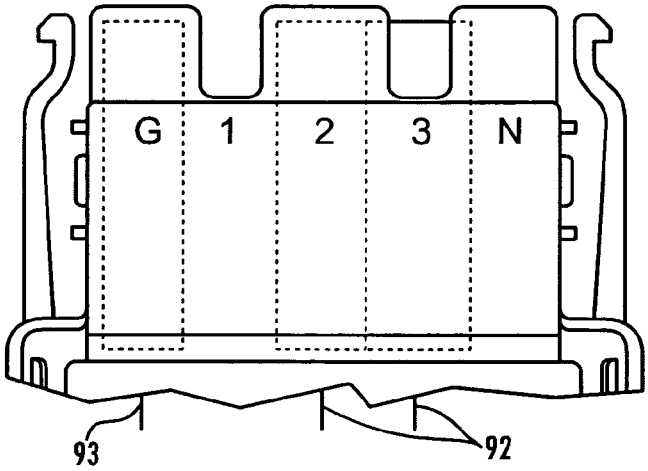
Figure 15C:
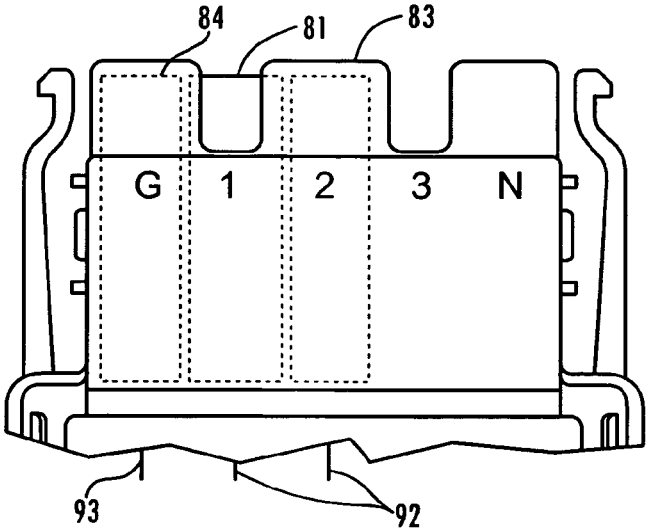
Figure 15D:
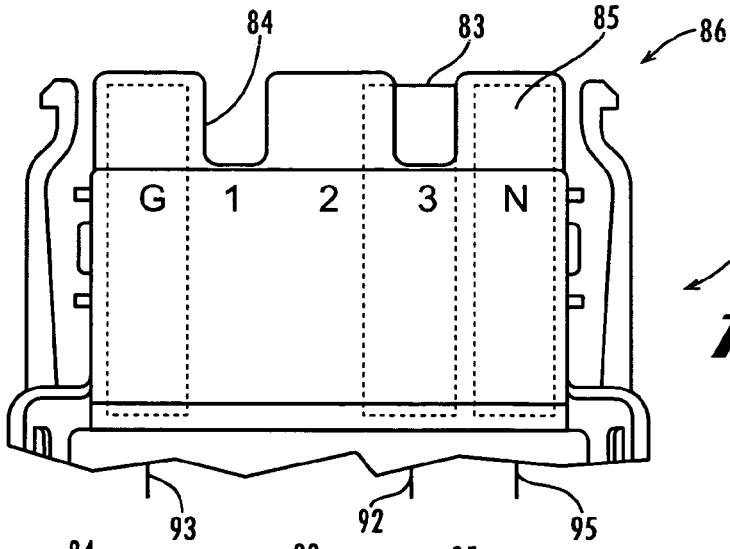
Figure 15E:
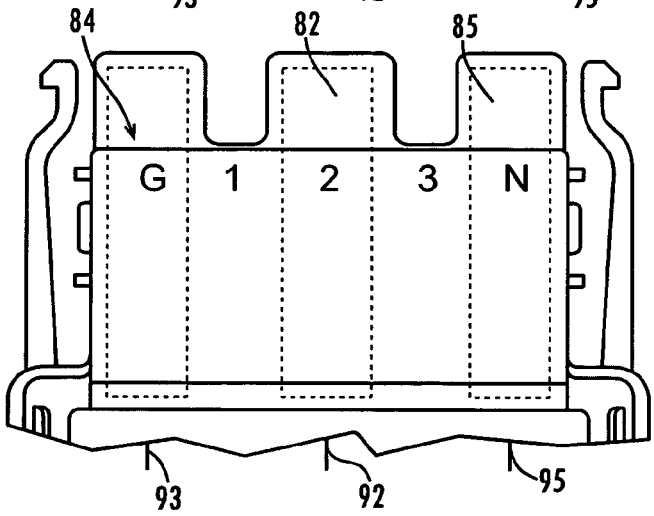
Figure 15F:
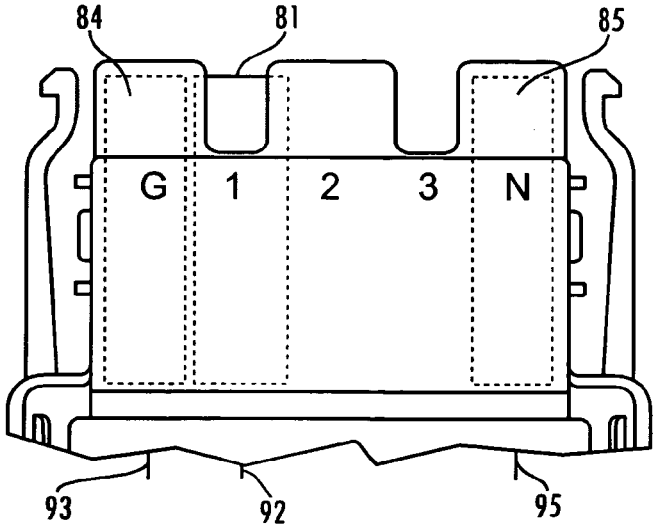

Exemplary connections of the conductors of the power cable 50 to the second array of terminals 46 are schematically illustrated in FIGS. 8A and 8B. In one example, the first power conductor 51 is operatively connected to the second power terminal 42 of the second array, the second power conductor 52 is operatively connected to the third power terminal 43 of the second array, and the third power conductor 53 is operatively connected to the first power terminal 41 of the second array. In an alternative example, the first power conductor 51 is operatively connected to the third power terminal 43 of the second array, the second power conductor 52 is operatively connected to the first power terminal 41 of the second array, and the third power conductor 53 is operatively connected to the second power terminal 42 of the second array.

For ease of use and manufacture, all of the power distribution cable assemblies 20 containing the permuting power conductors are identical. In one example, the conductors of the power cable system are all rated at 20 amperes, and are constructed of either #12 AWG or #10 AWG copper with 90° plastic insulation rated at 600 volts, except for the ground conductor, which is not insulated. However, it is noted that conductors made from other materials, such as, for example, aluminum, and the like, and having different ratings and different insulation can also be used and are contemplated.

The second power connector head 40 of the power distribution cable assembly 20 can also have a third fixed array of terminals 66 that includes three power terminals, a neutral terminal 65, and a ground terminal 64. As exemplarily shown, each respective terminal of the third array of terminals 60 is fixed relative to the other terminals in the same predetermined orientation of the first and second fixed array of terminals 36, 46. The neutral terminal 65 of the third fixed array of terminals is operatively connected to the neutral terminal 45 of the second fixed array of terminals. The ground terminal 64 of the third fixed array of terminals is operatively connected to the ground terminal 44 of the second fixed array of terminals. The first power terminal 61 of the third fixed array of terminals is operatively connected to the first power terminal 41 of the second fixed array of terminals. The second power terminal 62 of the third fixed array of terminals is operatively connected to the second power terminal 42 of the second fixed array of terminals. Finally, the third power terminal 63 of the third fixed array of terminals is operatively connected to the third power terminal 43 of the second fixed array of terminals.

The second and third terminal arrays 46, 66 of the second power connector head are exemplarily depicted as a conventional female terminal housing. It is contemplated that the second connector head can also be formed as a conventional male terminal housing. The second and/or third terminal array of the second connector head are constructed and arranged for operative connection of the respective terminal arrays to one of several additional power cables, cable extenders, fixtures or other loads. Exemplified examples of a second power connector head with first and second fixed terminal arrays are depicted in FIGS. 6–11 and are disclosed in U.S. Pat. No. 5,679,016.

In use, all of the terminals of the second and third terminal arrays 36, 66 are energized. The third fixed array of terminals 66 in the second power connector head adds flexibility to the system. The power distribution circuit can continue to other locations, fixtures or loads, while attaching a load cable assembly 70 or another power distribution cable assembly 20 to the third fixed array of terminals. Thus, having the third fixed array of terminals on the second power connector head 40 effectively adds the function of an electrical splitter to the power distribution cable assembly.

Referring to FIGS. 12–15F, an exemplified load cable assembly 70 is shown. In one embodiment, the load cable assembly 70 has a load connector head 80 that is operatively connected to a first end 96 of a length of load cable 90. A second end 98 of the load cable is operatively connected to a load, such as, for example, a fixture. The load connector head 80 has a fourth fixed array of terminals 86, which includes three terminals. Each of the three terminals in the fourth fixed array of terminals is fixed relative to each other in a predetermined orientation. The terminals of the fourth fixed array are positioned in order to mate to specific terminals in the releasable connected second or third fixed array of terminals of the second power connector head. The fourth fixed array of terminals 86 of the load connector head is constructed and arranged for releasable connection to one of the fixed arrays of the terminals of the second power connector head 40. The second, third and fourth fixed arrays are complementarily keyed so that the fourth array of terminals can only be operatively connected to the respective second or third array in a predetermined orientation.

In one example, if the desired load requires a line to line connection, the three terminals of the fourth array of terminals 86 are constructed and arranged to releasably connect to two of the power terminals and the ground terminal of the terminals in the second power connector head 40. Thus, the three terminals of the fourth fixed array of terminals include the ground terminal 84 and a pair of power terminals selected from a group consisting of the first power terminal 81, the second power terminal 82, and the third power terminal 83. In this example, the load cable has a pair of power conductors 92 and a ground conductor 93. Each of the power conductors of the pair of power conductors 92 is operatively connected to one power terminal of the selected pair of power terminals of the fourth fixed array of terminals 86 and the ground conductor 93 is operatively connected to the ground terminal 84 of the fourth fixed array.

In another example, if the load requires a line to neutral connection, the three preselected terminals of the fourth array of terminals are constructed and arranged to releasably connect to one power terminal, the neutral terminal, and the ground terminal of the array terminals in the second power connector head. In this example, the power terminal of the fourth fixed array of terminals is selected from a group consisting of the first power terminal 81, the second power terminal 82, and the third power terminal 83. In this example, the load cable 90 has a power conductor 92, a neutral conductor 95, and a ground conductor 93. The power conductor is operatively connected to the selected power terminal of the fourth fixed array, the neutral conductor is operatively connected to the neutral terminal of the fourth fixed array, and the ground conductor is operatively connected to the ground terminal of the fourth fixed array.

The fourth array of terminals is predetermined for the load and are fixed in the manufacturing process. Because the releasably connected second, third, fourth arrays are "fixed" in their orientation, all line to line connections utilize the "same" terminals on the connected array terminals of the second power connector head 40 and all line to neutral connections utilize the "same" terminals on the connected array terminals of the second power connector head 40. Thus, the installer of the fixtures or loads does not have to determine which phase of the power supply he should connect the load to in order to balance the distribution of power. The installer simply connects the complementary keyed terminal arrays of the power distribution cable assembly and the load cable assembly. Because the power cable assembly permutes the conductors, the system load is substantially balanced without the requirement of operator intervention in load selection and wiring.

In one example, the load connector head 80 is generally a female terminal housing that is constructed and arranged for releasable mating to any male terminal array, such as, for example, the second or third array of the second power connector head 40. However, as one skilled in the art will appreciate, if the second or third array of the second connector head were female terminal housings, the load connector head could be a male terminal housing. The conductors of the load cable can be enclosed in a number of different cables, such as a metal clad cable, a #16 AWG rubberized fixture cord, or other cords that the manufacturer so chooses.

Figure 16:
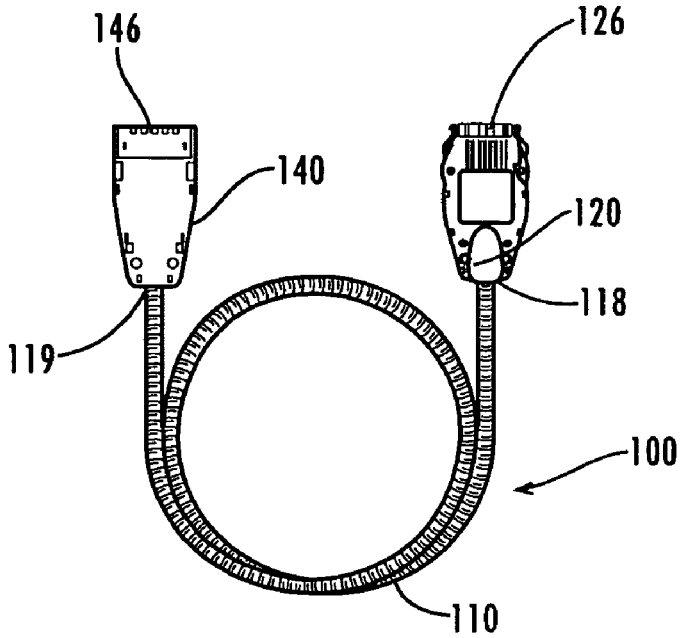
FIG. 16 is a plan view of an extension cable assembly of the present invention.
Figure 17:
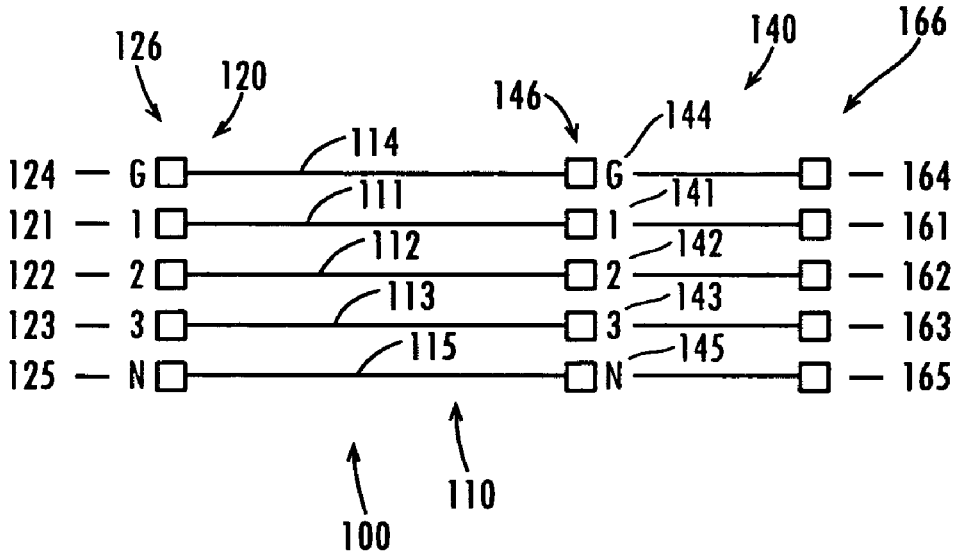
FIG. 17 is a schematic depiction of the wiring connections within respective arrays disposed in the respective connector heads of the extension cable assembly of FIG. 16.
Figure 1H:
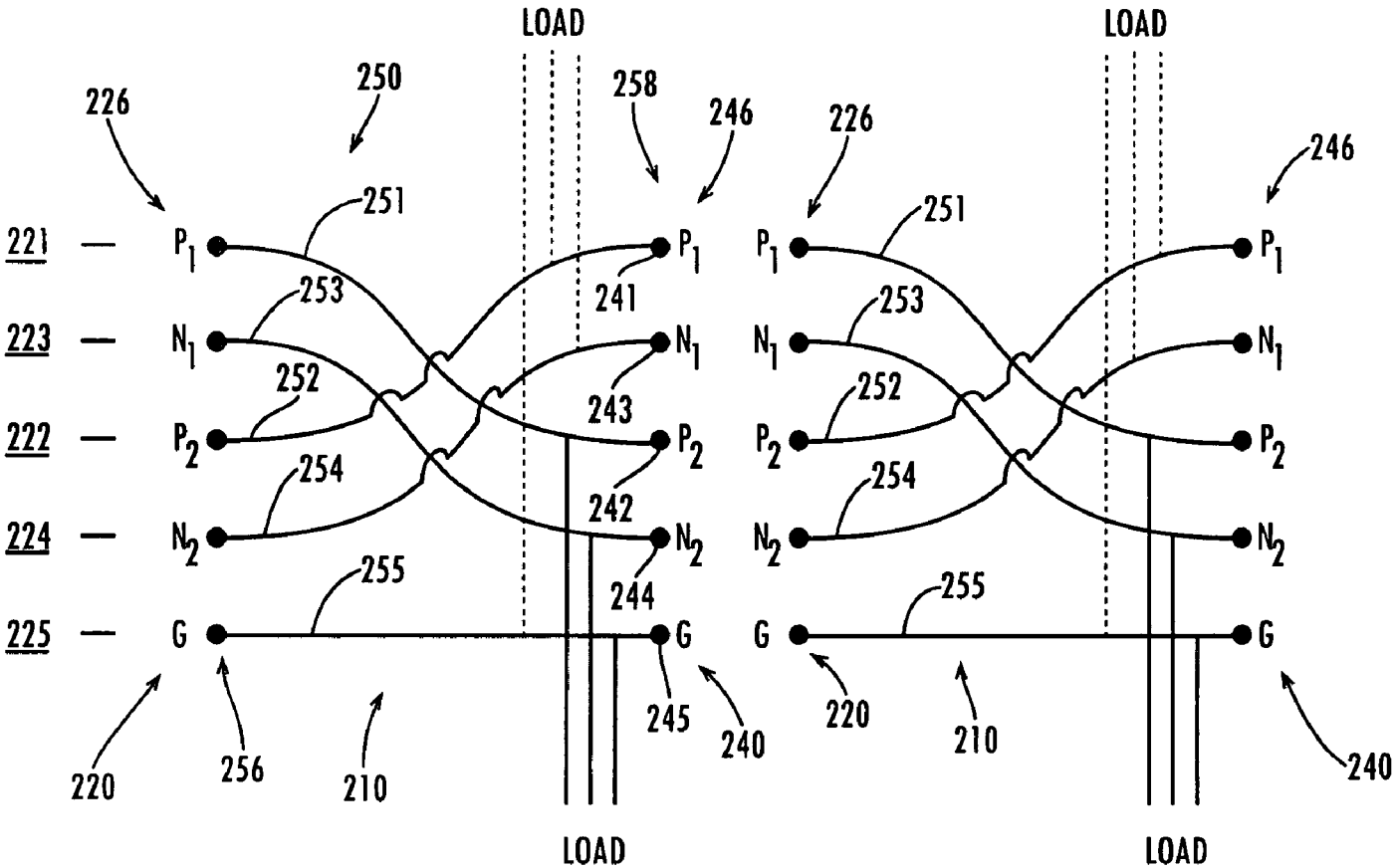

FIGS. 16 and 17 depicts an exemplified extension cable assembly 100 of the present invention. In one embodiment, the extension cable assembly has a length of extension cable 110, a first extension connector head 120 that is connected to a proximal end 118 of the extension cable, and a spaced second extension connector head 140 that is connected to a distal end 119 of the extension cable. The length of extension cable is depicted as a conventional metal clad cable, but other conventional cables, such as, for example, a polymer coated cable and the like are contemplated. The extension cable 110 has a first power conductor 111, a second power conductor 112, a third power conductor 113, a neutral conductor 115, and a ground conductor 114. The first extension connector head 120 has a fifth fixed array of terminals 126 that includes a first power terminal 121, a second power terminal 122, a third power terminal 123, a neutral terminal 125 and a ground terminal 124. The second extension cable connector head 140 has a sixth array of fixed terminals 146 and a seventh array of fixed terminals 166, each sixth and seventh array of fixed terminals having a first power terminal 141, 161, a second power terminal 142, 162, a third power terminal 143, 163, a neutral terminal 145, 165, and a ground terminal 144, 164. Each respective terminal in the fifth, sixth, and seventh arrays of terminals is fixed relative to each other in the same predetermined orientation as the first array of terminals 36. The extension cable is constructed and arranged so that each respective terminal in the sixth and seventh array of terminals is operably connected to the same conductor as the corresponding terminal in the fifth array of terminals. Essentially, the extension cable assembly 100 acts to extend the circuits to which it is attached.

The exemplified arrays of terminals formed in the extension cable connector heads 120, 140 are identical to those of the power connector heads 30, 40 of the power distribution cable assembly. Therefore, they are constructed and arranged for releasable attachment to the power connector heads, the load connector heads, and other supply or fixture heads that may be on the system.

Figure 19:
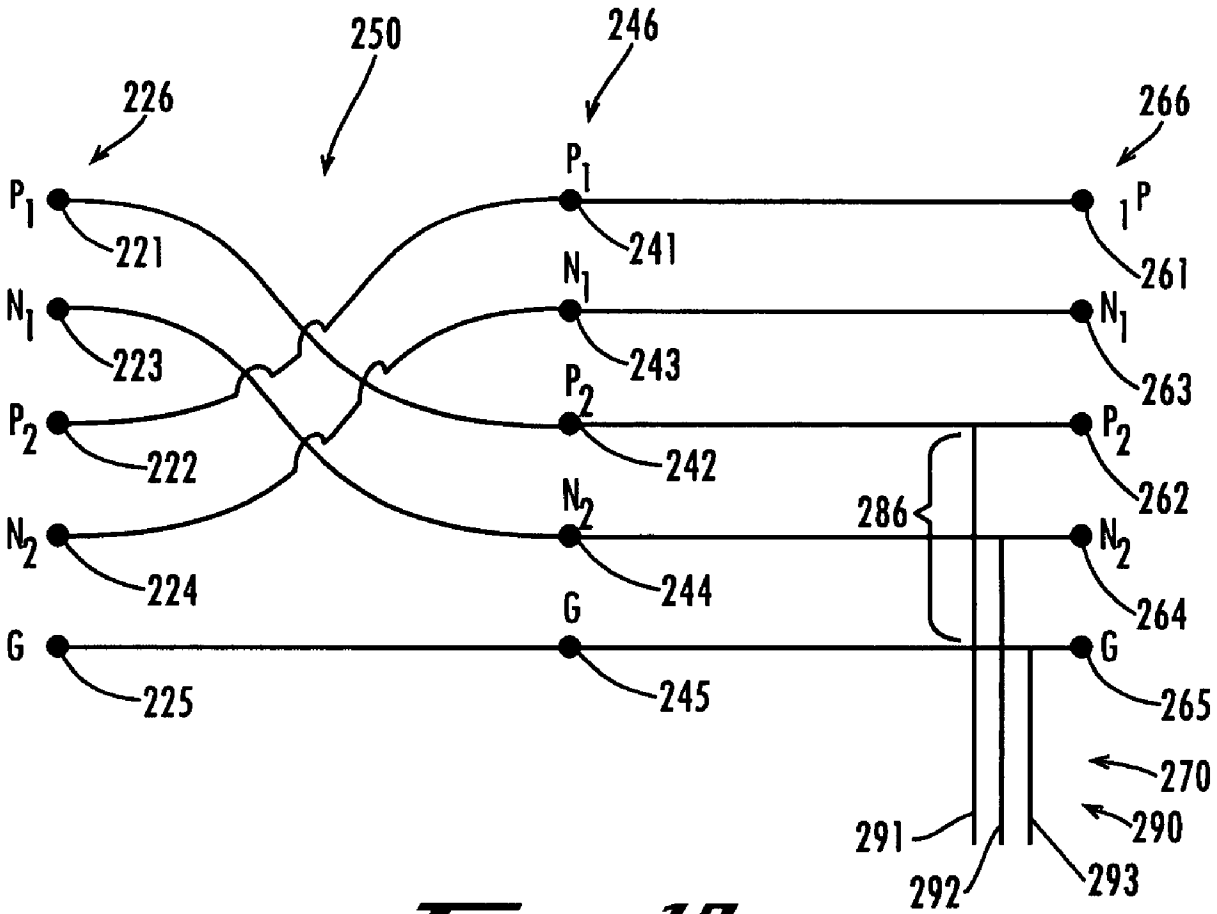
FIG. 19 is a schematic depiction of the wiring connections within respective first, second and third arrays disposed in the respective first and second connector heads of the power distribution cable assembly of FIG. 18.
Figure 21:
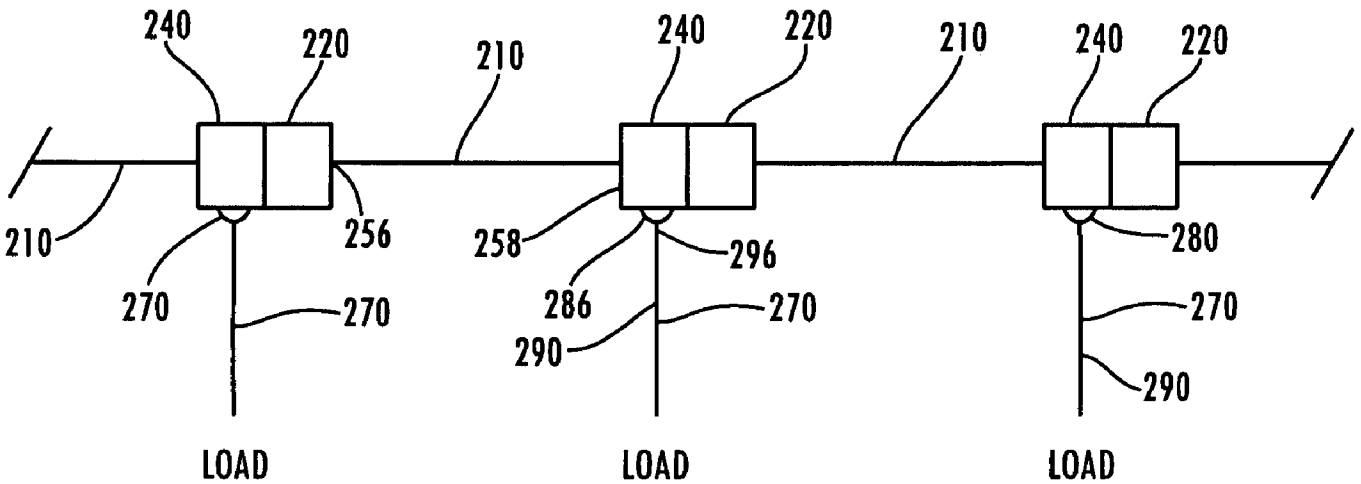

An alternative embodiment of the wiring system 10 of the present invention is shown in FIGS. 18–20. Here, the wiring system comprises a power distribution cable assembly 220 having a length of power cable 250, a first power connector head 220, and a second power connector head 240. The power cable 250 is conventional and has a first power conductor 251, a second power conductor 252, a first neutral conductor 253, a second neutral conductor 254, and a ground conductor 255.

The first power connector head 220 is operatively connected to a proximal end 256 of the power cable and has a first fixed array of terminals 226. The first fixed array of terminals includes a first power terminal 221, a second power terminal 222, a first neutral terminal 223, a second neutral terminal 224, and a ground terminal 225. The first fixed array of terminals 226 is operatively connected to the conductors of the power cable 250 such that the first power terminal of the first array is connected to the first power conductor, the second power terminal of the first array is connected to the second power conductor, the first neutral terminal of the first array is connected to the first neutral conductor, the second neutral terminal of the first array is connected to the second neutral conductor, and the ground terminal of the first array is connected to the ground conductor.

The second power connector head 240 is operatively connected to a distal end 258 of the power cable 250 and includes a second fixed array of terminals 246, which includes a first power terminal 241, a second power terminal 242, a first neutral terminal 243, a second neutral terminal 244, and a ground terminal 245. Each respective terminal of the second fixed array of terminals 246 is operatively connected to conductors of the power cable 250 such that the first neutral conductor 253 is connected to the second neutral terminal 244 of the second array, the second neutral conductor 254 is connected to the first neutral terminal 243 of the second array, the first power conductor 251 is connected to the second power terminal 242 of the second array, the second power conductor 252 is connected to the first power terminal 241 of the second array, the ground conductor 255 is connected to the ground terminal 245.

The second power connector head 240 also has a third fixed array of terminals 266 that includes a first power terminal 261, a second power terminal 262, a first neutral terminal 263, a second neutral terminal 264, and a ground terminal 265. The first power terminal 261 of the third array being operatively connected to the first power terminal 241 of the second array, the second power terminal 262 of the third array being operatively connected to the second power terminal 242 of the second array, the first neutral terminal 263 of the third array being operatively connected to the first neutral terminal 243 of the second array, the second neutral terminal 264 of the third array being operatively connected to the second neutral terminal 244 of the second array, and the ground terminal 265 of the third array being operatively connected to the ground terminal 245 of the second array.

Each respective terminal of the first array of terminals 226 is fixed relative to each other in a predetermined orientation. Similarly, each respective terminal of the second fixed array of terminals 246 is fixed relative to each other in the same predetermined orientation as the first fixed array of terminals. Each respective terminal of the third fixed array of terminals i266 s fixed relative to each other in the same predetermined orientation as the first and second fixed arrays of terminals 226, 246.

The wiring system may also comprise a load cable assembly 270 constructed and arranged for connection to one of the second and third arrays of terminals of the second power connector head 240. The load cable assembly includes a load connector head 280 and a length of load cable 290, which has a second end 298 that is operatively connected to a load. The exemplified load connector head is operatively connected to a first end 296 of the load cable and has a fourth fixed array of terminals 286. The fourth fixed array of terminals includes three terminals selected from a group consisting of a first power terminal 281, a second power terminal 282, a first neutral terminal 283, a second neutral terminal 284, and a ground terminal 285. The selected three terminals of the fourth fixed array of terminals are fixed relative to each other in the predetermined orientation. The fourth fixed array of terminals 286 of the load cable connector head 280 is constructed and arranged for releasable connection to one of the fixed arrays of terminals of the second power connector head 240.

In one example, the three terminals of the fourth fixed array of terminals include the ground terminal 285, one power terminal selected from a group consisting of the first power terminal 281 and the second power terminal 282, and one neutral terminal selected from a group consisting of the first neutral terminal 283 and the second neutral terminal 284. In this example, the length of load cable 290 has a power conductor 291, a neutral conductor 292, and a ground conductor 293. The power conductor of the load cable is operatively connected to the selected power terminal of the fourth fixed array. Similarly, the neutral conductor of the load cable is connected to the selected neutral conductor of the fourth fixed array, and the ground conductor of the load cable is operatively connected to the ground terminal of the fourth fixed array.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A wiring system for distributing three-phase power from a three-phase power supply, comprising:

a power distribution cable assembly, comprising:

a length of power cable having a first power conductor, a second power conductor, a third power conductor, a neutral conductor, and a ground conductor;

a first power connector head operatively connected to a proximal end of the power cable, the first connector head having a first fixed array of terminals that includes a first power terminal, a second power terminal, a third power terminal, a neutral terminal, and a ground terminal, each respective terminal of the first array being fixed relative to each other in predetermined orientation and being operatively connected to the power cable such that the first power terminal of the first array is connected to the first power conductor, the second power terminal of the first array is connected to the second power conductor, the third power terminal of the first array is connected to the third power conductor, the neutral terminal of the first array is connected to the neutral power conductor, and the ground terminal of the first array is connected to the ground power conductor, the first fixed array of terminals being operatively connected to the three-phase power supply such that each respective phase of three-phase power supply is supplied to a separate power terminal of the first array of terminals;

a second power connector head operatively connected to a distal end of the power cable, the second power connector head having a second fixed array of terminals that includes a first power terminal, a second power terminal, a third power terminal, a neutral terminal, and a ground terminal, each respective terminal of the second fixed array of terminals being fixed relative to each other in the same predetermined orientation as the first fixed array of terminals, wherein each respective terminal of the second fixed array of terminals is operatively connected to the power cable such that the neutral conductor is connected to the neutral terminal of the second array, the ground conductor is connected to the ground terminal of the second array, the first power conductor is connected to one power terminal of the second fixed array that is selected from a group consisting of the second power terminal and the third power terminal, the second power conductor is connected to one power terminal of the second array that is selected from a group consisting of the first power terminal and the third power terminal, the third power conductor is connected to one power terminal of the second array that is selected from a group consisting of the first power terminal and the second power terminal, and wherein each power terminal of the second array is connected to one power conductor.

2. The wiring system of claim 1, wherein the first power conductor is operatively connected to the second power terminal of the second array, wherein the second power conductor is operatively connected to the third power terminal of the second array, and wherein the third power conductor is operatively connected to the first power terminal of the second array.

3. The wiring system of claim 1, wherein the first power conductor is operatively connected to the third power terminal of the second array, wherein the second power conductor is operatively connected to the first power terminal of the second array, and wherein the third power conductor is operatively connected to the second power terminal of the second array.

4. The wiring system of claim 1, wherein the second power connector head has a third fixed array of terminals that includes a first power terminal, a second power terminal, a third power terminal, a neutral terminal, and a ground terminal, each respective terminal of the third fixed array of terminals being fixed relative to each other in the same predetermined orientation as the second fixed array of terminals, the first power terminal of the third array being operatively connected to the first power terminal of the second array, the second power terminal of the third array being operatively connected to the second power terminal of the second array, the third power terminal of the third array being operatively connected to the third power terminal of the second array, the neutral terminal of the third array being operatively connected to the neutral terminal of the second array, and the ground terminal of the third array of terminals being operatively connected to the ground terminal of the second array.

5. The wiring system of claim 4, further comprising:

a load cable assembly, comprising:

a length of load cable having a first end and a spaced second end, the second end being operatively connected to a load; and a load connector head operatively connected to the first end of the load cable, the load connector head having a fourth fixed array of terminals that includes three terminals selected from a group consisting of a first power terminal, a second power terminal, a third power terminal, a neutral terminal, and a ground terminal, the three terminals of the fourth fixed array of terminals being fixed relative to each other in predetermined orientation, wherein the fourth fixed array of terminals of the load connector head is constructed and arranged for releasable connection to one of the fixed arrays of terminals of the second power connector head.

6. The wiring system of claim 5, wherein the three terminals of the fourth fixed array of terminal include the ground terminal and a pair of power terminals selected from a group consisting of the first power terminal, the second power terminal, and the third power terminal.

7. The wiring system of claim 6, wherein the length of load cable has a pair of power conductors and a ground conductor, wherein each of the power conductors of the pair of power conductors is operatively connected to one power terminal of the selected pair of power terminals of the fourth fixed array, and wherein the ground conductor is operatively connected to the ground terminal of the fourth fixed array.

8. The wiring system of claim 5, wherein the three terminals of the fourth fixed array of terminal include the ground terminal, the neutral terminal, and a power terminal selected from a group consisting of the first power terminal, the second power terminal, and the third power terminal.

9. The wiring system of claim 8, wherein the length of load cable has a power conductor, a neutral conductor, and a ground conductor, the power conductor being operatively connected to the selected power terminal of the fourth fixed array, the neutral conductor being operatively connected to the neutral terminal of the fourth fixed array, and the ground conductor being operatively connected to the ground terminal of the fourth fixed array.

10. The wiring system of claim 5, further comprising:

an extension cable assembly, comprising:

a length of extension cable having a first power conductor, a second power conductor, a third power conductor, a neutral conductor, and a ground conductor;

a first extension connector head being connected to a proximal end of the extension cable, the first extension connector head having a fifth fixed array of terminals that includes a first power terminal, a second power terminal, a third power terminal, a neutral terminal, and a ground terminal, each respective terminal of the fifth array being fixed relative to each other the same predetermined orientation as the first array of terminals, the respective power terminals of the fifth array of terminals being operatively connected to the extension cable such that the first power terminal of the fifth array is connected to the first power conductor, the second power terminal of the fifth array is connected to the second power conductor, the third power terminal of the fifth array is connected to the third power conductor, the neutral terminal of the fifth array is connected to the neutral conductor, and the ground terminal of the fifth array is connected to the ground conductor;

a second extension cable connector head being connected to a distal end of the extension cable, the second extension cable connector head having a sixth fixed array of terminals and a seventh array of terminals, each of the sixth and seventh array of terminals having a first power terminal, a second power terminal, a third power terminal, a neutral terminal, and a ground terminal, each respective terminal of the sixth and seventh arrays being fixed relative to each other in the same predetermined orientation as the fifth array of terminals, wherein the respective power terminals of the sixth array of terminals is operatively connected to the extension cable such that the first power terminal of the sixth array is connected to the first power conductor, the second power terminal of the sixth array is connected to the second power conductor, the third power terminal of the sixth array is connected to the third power conductor, the neutral terminal of the sixth array is connected to the neutral conductor, and the ground terminal of the sixth array is connected to the ground conductor, and wherein the first power terminal of the seventh array is operatively connected to the first power terminal of the sixth array, the second power terminal of the seventh array is operatively connected to the second power terminal of the sixth array, the third power terminal of the seventh array is operatively connected to the third power terminal of the sixth array, the neutral terminal of the seventh array is operatively connected to the neutral terminal of the sixth array, and the ground terminal of the seventh array of terminals is operatively connected to the ground terminal of the sixth array.

11. The wiring system of claim 10, wherein the fifth fixed array of terminals of the first extension cable connector head is constructed and arranged for releasable connection to one of the fixed arrays of terminals of the second power connector head of the power distribution cable assembly.

12. The wiring system of claim 10, wherein the fourth fixed array of terminals of the load connector head is constructed and arranged for releasable connection to one of the fixed arrays of terminals of the second extension connector head.

13. A power distribution cable assembly, comprising:

a length of power cable having a first power conductor, a second power conductor, a third power conductor, a neutral conductor, and a ground conductor;

a first power connector head operatively connected to a proximal end of the power cable, the first power connector head having a first fixed array of terminals that includes a first power terminal, a second power terminal, a third power terminal, a neutral terminal, and a ground terminal, each respective terminal of the first array being fixed relative to each other in predetermined orientation and being operatively connected to the power cable such that the first power terminal of the first array is connected to the first power conductor, the second power terminal of the first array is connected to the second power conductor, the third power terminal of the first array is connected to the third power conductor, the neutral terminal of the first array is connected to the neutral conductor, and the ground terminal of the first array is connected to the ground conductor, the first fixed array of terminals being operatively connected to the three-phase power supply such that each respective phase of a three-phase power supply is supplied to a separate power terminals of the first array of terminals;

a second power connector head operatively connected to a distal end of the power cable, the second power connector head having a second fixed array of terminals that includes a first power terminal, a second power terminal, a third power terminal, a neutral terminal, and a ground terminal, each respective terminal of the second fixed array of terminals being fixed relative to each other in the same predetermined orientation as the first fixed array of terminals, wherein each respective terminal of the second fixed array of terminals is operatively connected to the power cable such that the neutral conductor is connected to the neutral terminal of the second array, the ground conductor is connected to the ground terminal of the second array, the first power conductor is connected to one power terminal of the second fixed array that is selected from a group consisting of the second power terminal and the third power terminal, the second power conductor is connected to one power terminal of the second array that is selected from a group consisting of the first power terminal and the third power terminal, the third power conductor is connected to one power terminal of the second array that is selected from a group consisting of the first power terminal and the second power terminal, and wherein each power terminal of the second array is connected to one power conductor.

14. The cable assembly of claim 13, wherein the first power conductor is operatively connected the second power terminal of the second array, wherein the second power conductor is operatively connected to the third power terminal of the second array, and wherein the third power conductor is operatively connected to the first power terminal of the second array.

15. The cable assembly of claim 13, wherein the first power conductor is operatively connected the third power terminal of the second array, wherein the second power conductor is operatively connected to the first power terminal of the second array, and wherein the third power conductor is operatively connected to the second power terminal of the second array.

16. The cable assembly of claim 13, wherein the second power connector head has a third fixed array of terminals that includes a first power terminal, a second power terminal, a third power terminal, a neutral terminal, and a ground terminal, each respective terminal of the third fixed array of terminals being fixed relative to each other in the same predetermined orientation as the second fixed array of terminals, the first power terminal of the third array being operatively connected to the first power terminal of the second array, the second power terminal of the third array being operatively connected to the second power terminal of the second array, the third power terminal of the third array being operatively connected to the third power terminal of the second array, the neutral terminal of the third array being operatively connected to the neutral terminal of the second array, and the ground terminal of the third array of terminals being operatively connected to the ground terminal of the second array.

17. A wiring system, comprising:

a power distribution cable assembly, comprising:

a length of power cable having a first power conductor, a second power conductor, a first neutral conductor, a second neutral conductor, and a ground conductor;

a first power connector head operatively connected to a proximal end of the power cable, the first connector head having a first fixed array of terminals that includes a first power terminal, a second power terminal, a first neutral terminal, a second neutral terminal, and a ground terminal, each respective terminal of the first array being fixed relative to each other in predetermined orientation and being operatively connected to the power cable such that the first power terminal of the first array is connected to the first power conductor, the second power terminal of the first array is connected to the second power conductor, the first neutral terminal of the first array is connected to the first neutral conductor, the second neutral terminal of the first array is connected to the second neutral conductor, and the ground terminal of the first array is connected to the ground conductor;

a second power connector head operatively connected to a distal end of the power cable, the second power connector head having a second fixed array of terminals that includes a first power terminal, a second power terminal, a first neutral terminal, a second neutral terminal, and a ground terminal, each respective terminal of the second fixed array of terminals being fixed relative to each other in the same predetermined orientation as the first fixed array of terminals, wherein each respective terminal of the second fixed array of terminals is operatively connected to the power cable such that the first neutral conductor is connected to the second neutral terminal of the second array, the second neutral conductor is connected to the first neutral terminal of the second array, the first power conductor is connected to the second power terminal of the second array, the second power conductor is connected to the first power terminal of the second array, the ground conductor is connected to the ground terminal.

18. The wiring system of claim 17, wherein the second power connector head has a third fixed array of terminals that includes a first power terminal, a second power terminal, a first neutral terminal, a second neutral terminal, and a ground terminal, each respective terminal of the third fixed array of terminals being fixed relative to each other in the same predetermined orientation as the second fixed array of terminals, the first power terminal of the third array being operatively connected to the first power terminal of the second array, the second power terminal of the third array being operatively connected to the second power terminal of the second array, the first neutral terminal of the third array being operatively connected to the first neutral terminal of the second array, the second neutral terminal of the third array being operatively connected to the second neutral terminal of the second array, and the ground terminal of the third array being operatively connected to the ground terminal of the second array.

19. The wiring system of claim 18, further comprising:

a load cable assembly, comprising:

a length of load cable having a first end and a spaced second end, the second end being operatively connected to a load; and a load connector head operatively connected to a first end of the load cable, the load connector head having a fourth fixed array of terminals that includes three terminals selected from a group consisting of a first power terminal, a second power terminal, a first neutral terminal, a second neutral terminal, and a ground terminal, the three terminals of the fourth fixed array of terminals being fixed relative to each other in predetermined orientation, wherein the fourth fixed array of terminals of the load cable connector head is constructed and arranged for releasable connection to one of the fixed arrays of terminals of the second power connector head.

20. The wiring system of claim 19, wherein the three terminals of the fourth fixed array of terminals include the ground terminal, one power terminal selected from a group consisting of the first power terminal and the second power terminal, and one neutral terminal selected from a group consisting of the first neutral terminal and the second neutral terminal.

21. The wiring system of claim 20, wherein the length of load cable has a power conductor, a neutral conductor, and a ground conductor, wherein the power conductor is operatively connected to the selected power terminal of the fourth fixed array, wherein the neutral conductor is connected to the selected neutral conductor of the fourth fixed array, and wherein the ground conductor is operatively connected to the ground terminal of the fourth fixed array.

* * * * *